US006318413B1

(12) United States Patent
Herring

(10) Patent No.: US 6,318,413 B1
(45) Date of Patent: Nov. 20, 2001

(54) PAPERMAKING FABRIC SEAM WITH ADDITIONAL THREADS IN THE SEAM AREA

(75) Inventor: Samuel H. Herring, Simpsonville, SC (US)

(73) Assignee: Astenjohnson, Inc., Charleston, SC (US)

( * ) Notice: Subject to any disclaimer, the term of this patent is extended or adjusted under 35 U.S.C. 154(b) by 0 days.

(21) Appl. No.: 09/385,583

(22) Filed: Aug. 27, 1999

Related U.S. Application Data

(60) Provisional application No. 60/098,547, filed on Aug. 31, 1998, provisional application No. 60/097,831, filed on Aug. 31, 1998, provisional application No. 60/098,566, filed on Aug. 31, 1998, provisional application No. 60/098,567, filed on Aug. 31, 1998, and provisional application No. 60/098,573, filed on Aug. 31, 1998.

(51) Int. Cl.[7] ..... D03D 13/00; D21F 1/00; D21F 7/10

(52) U.S. Cl. ..... 139/383 AA; 442/270; 428/58; 428/193; 162/904

(58) Field of Search ..... 139/383 AA; 442/270; 428/58, 193; 162/904

(56) References Cited

U.S. PATENT DOCUMENTS

| | | | |
|---|---|---|---|
| 3,316,599 | 5/1967 | Wagner . | |
| 4,186,780 | 2/1980 | Josef et al. . | |
| 4,438,789 | 3/1984 | MacBean | 139/383 A |
| 4,601,785 | 7/1986 | Lilja et al. . | |
| 4,842,925 | 6/1989 | Dufour et al. . | |
| 4,979,543 | 12/1990 | Moriarty et al. . | |
| 5,188,884 | 2/1993 | Smith . | |
| 5,458,161 | 10/1995 | Scarfe . | |
| 5,476,123 | 12/1995 | Rydin . | |
| 5,531,251 | 7/1996 | Rydin . | |
| 5,799,709 | 9/1998 | Shipley . | |
| 5,913,339 | 6/1999 | Lee . | |

*Primary Examiner*—Andy Falik
(74) *Attorney, Agent, or Firm*—Volpe & Koenig, P.C.

(57) ABSTRACT

An open ended papermaker's fabric of a type woven from a longitudinal thread system and a transverse thread system wherein a plurality of seam loops are formed at each end of the fabric by the threads of the longitudinal thread system. A seam zone exists at each end of the fabric between the respective seam loops and the last thread of the transverse thread system. Two additional transverse threads are interwoven with the longitudinal thread system in at least one seam zone in complementary weave repeat patterns that combine to provide a paper side repeated pattern of over one, under one across the repeat.

8 Claims, 6 Drawing Sheets

PAPERMAKING FABRIC SEAM WITH ADDITIONAL THREADS IN THE SEAM AREA

This application claims the benefit of: U.S. Provisional Application Serial No. 60/098,547, filed Aug. 31, 1998; U.S. Provisional Application Serial No. 60/097,831, filed Aug. 31,1998; U.S. Provisional Application Serial No. 60/098,566, filed Aug. 31,1998; U.S. Provisional Application Serial No. 60/098,567, filed Aug. 31, 1998; and U.S. Provisional Application Serial No. 60/098,573, filed August 31, 1998.

BACKGROUND

The present invention generally relates to an open ended, woven fabric which is designed for use in a papermaking, cellulose or board manufacturing machine. The fabric has a plurality of loops at each end to form a seam for rendering the fabric endless.

As will be known to those skilled in the art, papermaking machines generally include three sections commonly referred to as the forming, press and dryer sections. The present invention finds particular application in the press section of a papermaking machine.

Typically, press felts include a supporting base, such as a woven fabric, and a paper carrying or supporting layer. Frequently, the paper support layer is a homogeneous, nonwoven batt that has been affixed to the base. Base fabrics are typically woven fabrics which are used as an endless loop. Such an endless loop fabric may be woven endless with no seam or the fabric may be woven with two ends which are joined by a seam. Typical seams include pin type seams which utilize a pintle inserted through seam loops to close the fabric.

Some prior art seams have employed threads in the seam area to increase batt adhesion. However, these efforts have not always produced the desired contact area or the desired interconnection between paper and machine side machine direction threads.

As a result, there exists a need in seam loop construction to provide increased surface contact in the seam zone for better batt anchorage and a better interconnection between the paper and machine sides.

SUMMARY

The present invention relates to an open ended papermaker's fabric of a type woven from a longitudinal thread system and a transverse thread system. A plurality of seam loops are formed at each end of the fabric by the threads of the longitudinal thread system. A seam zone exists at each end of the fabric between the respective seam loops and the last thread of the transverse thread system. Two additional transverse threads are interwoven with the longitudinal thread system in at least one seam zone in complementary weave repeat patterns that combine to provide a paper side repeated pattern of over one, under one across the repeat.

DESCRIPTION OF THE PREFERRED EMBODIMENTS

Figure 1:
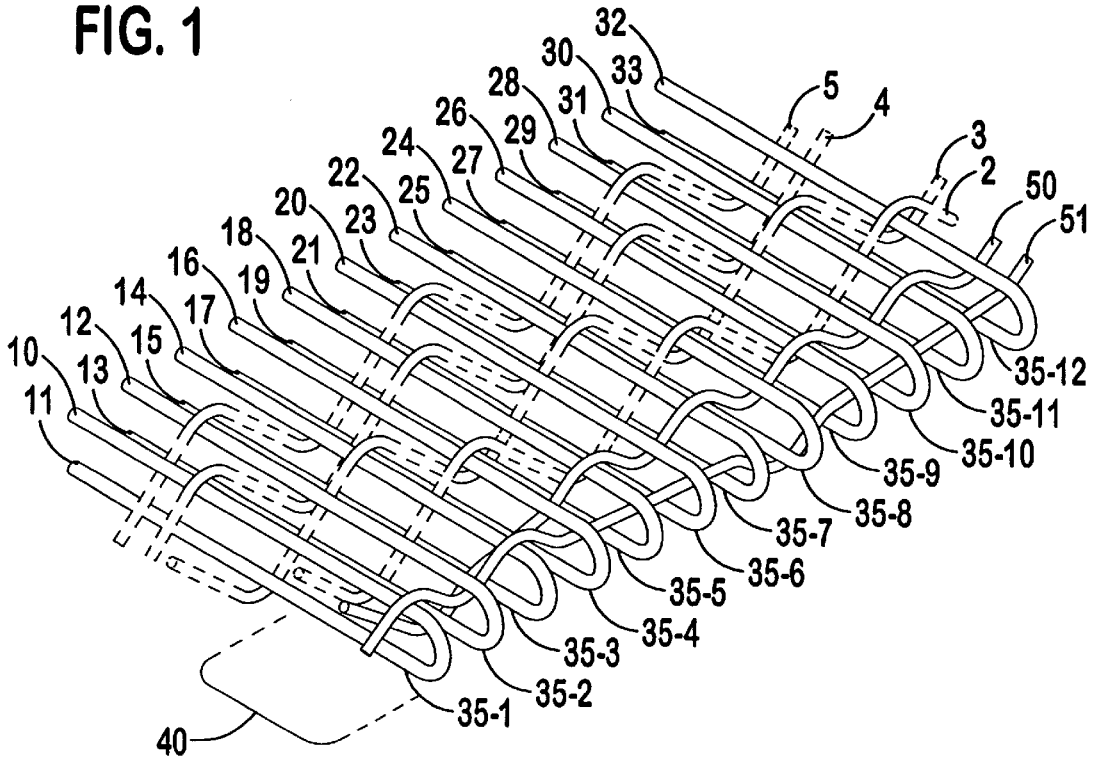
FIG. 1 shows a portion of the longitudinal seam loops in a fabric having additional cross machine direction threads in accordance with the present invention.
Figure 2:
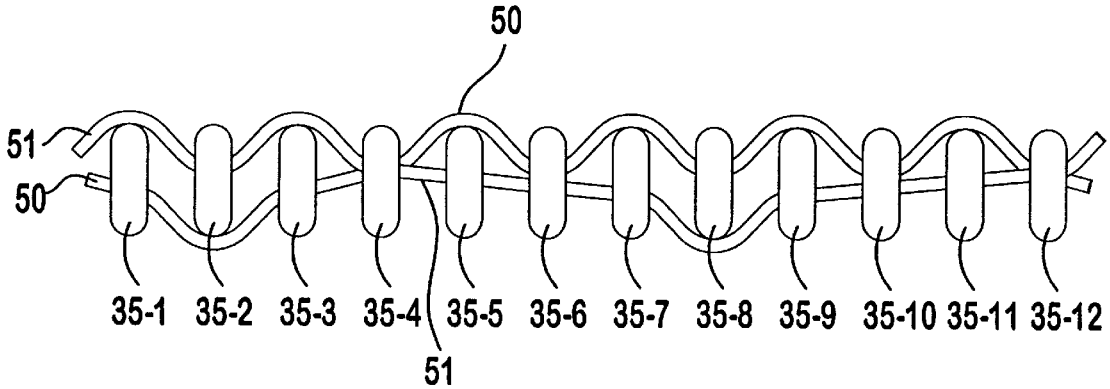
FIG. 2 is a front elevation of the seam loops and additional threads shown in FIG. 1.

The preferred embodiments will be described with reference to the drawing figures wherein like numerals represent like elements throughout.

Referring to FIG. 1, it shows a portion of the base fabric seamloops with additional threads woven in accordance with the present invention. The base fabric comprises a top layer of MD longitudinal threads, 10, 12, 14, 16, 18, 20, 22, 24, 26, 28, 30, and 32, and a bottom layer of MD longitudinal threads, 11, 13, 15, 17, 19, 21, 23, 25, 27, 29, 31 and 33. It will be understood that the top and bottom layers are essentially continuous threads which are connected through the respective seam loop 35-1 through 35-12 extending between the top and bottom layers.

Typically, the phantom CMD threads 2–5 are interwoven with the top and bottom longitudinal threads in a given repeat pattern to form the body of the fabric which forms no part of the present invention. A seam zone 40 exists between the end CMD thread 2 and the seam loops.

Figure 3:
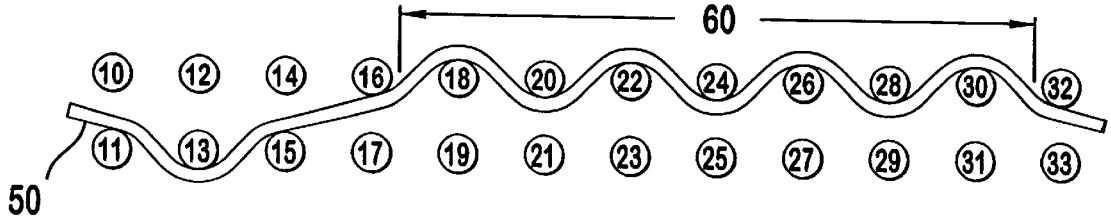
FIG. 3 illustrates one weave repeat pattern for one of the additional threads.
Figure 4:
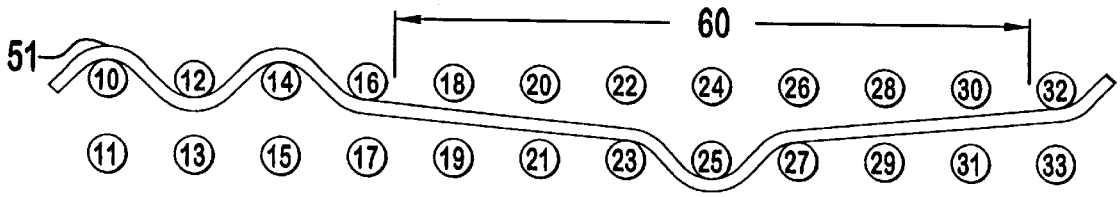
FIG. 4 illustrates one weave repeat for a second additional thread.
Figure 5:
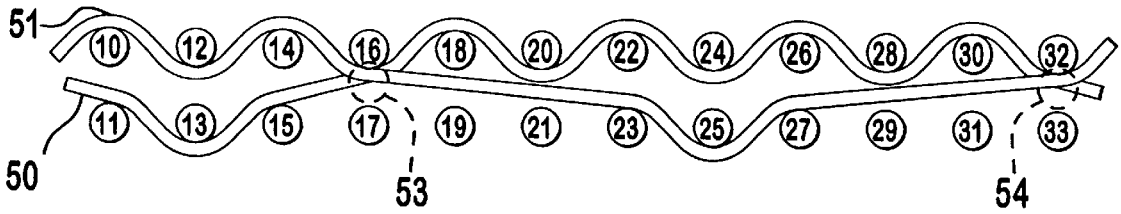
FIG. 5 shows the weave repeats of FIGS. 3 and 4 combined but without the seam loops as shown in FIG. 2.

Reference is now made to FIGS. 3, 4 and 5. Although some benefits will be obtained with a single additional thread, the preferred embodiments use two additional threads for more uniformity in the paper side surface. The two additional threads 50 and 51 are interwoven in the seam zone 40 with both layers of longitudinal threads 10 through 33. Additional CMD thread 50 preferably weaves in a repeat pattern that passes between MD threads 10–11, under MD threads 12–13, between MD thread pairs 14–15, 16–17, and then weaves a continuous portion of plain weave with top layer MD threads 18, 20, 22, 24, 26, 28, 30 before transitioning down between MD threads 32–33. With reference to FIG. 4, the second additional thread 51 is woven in a complementary pattern to that of thread 50. Additional thread 51 weaves a plain weave construction with top layer threads 10, 12, 14 before transitioning into a mid-plane float between MD thread pairs 16–17,18–19,20–21,22–23, weaving under MD threads 24–25 and transitioning back to a mid-plane float beneath thread pairs 26–27, 28–29, 30–31, 32–33.

Figure 6:
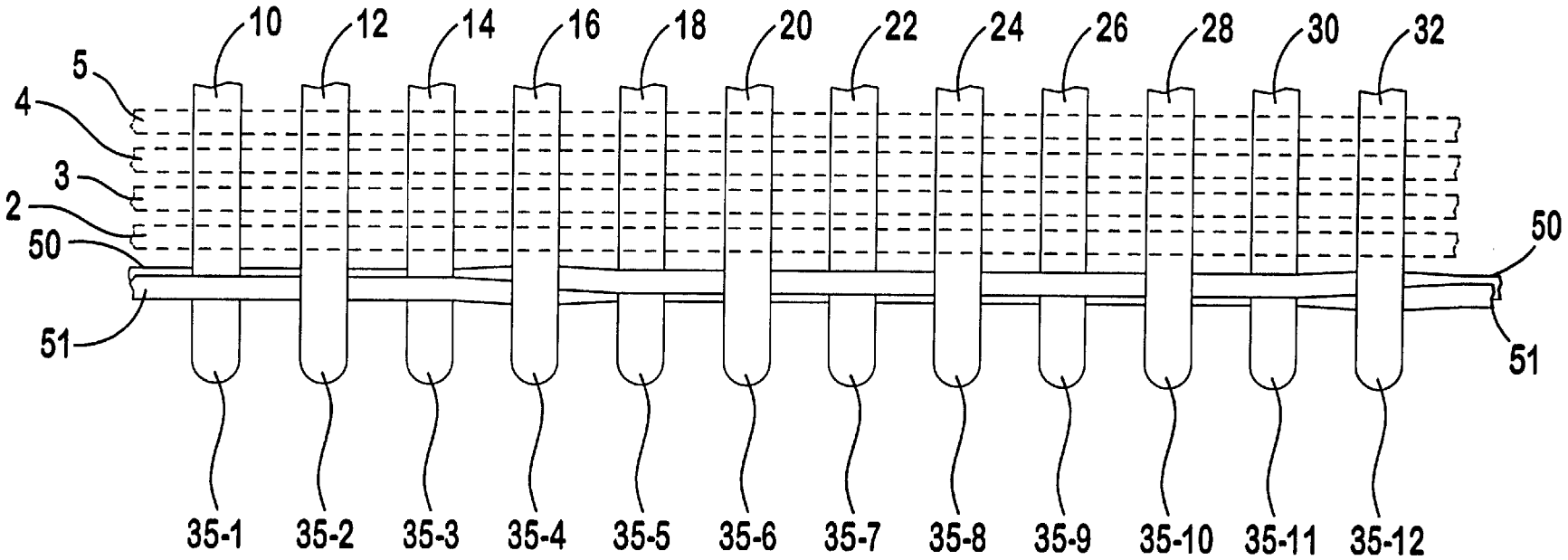
FIG. 6 is a top plan view of the combined weave patterns as illustrated in FIGS. 1, 2 and 5.

As can be seen from FIG. 5, two additional threads interwoven in accordance with FIGS. 3 and 4 will produce a weave repeat structure having the appearance of a plain weave in the upper layer and two crossover points 53 and 54 which are spaced apart by at least seven MD threads. This results from the additional longitudinal thread being in a continuous portion 60 of the weave repeat with seven adjacent MD threads between transitions from the machine or paper side longitudinal threads. Since the repeat pattern extends over twelve pairs of MD threads with only a single interlacing in the machine side MD layer and the additional threads can shift relative to each other, threads 50 and 51 tend to act as one thread in a continuous plain weave on the top layer. As a result of the long transitions and the interlacing patterns, the additional threads can migrate relative to each other to produce the desired sheet side weave pattern while also providing mid-plane floats and long transitions. The result of this weave configuration is illustrated in FIG. 6.

Figure 7:
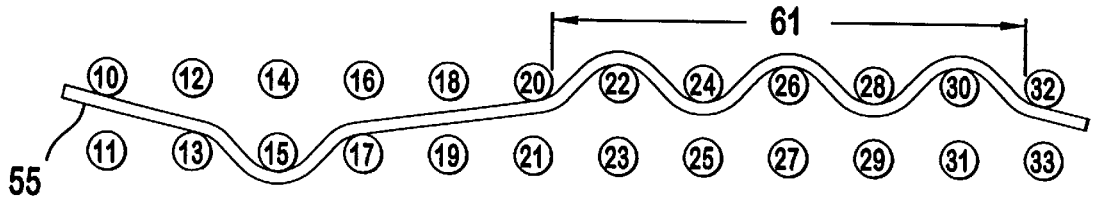
FIG. 7 illustrates the weave repeat for one additional thread in accordance with a second embodiment.
Figure 8:
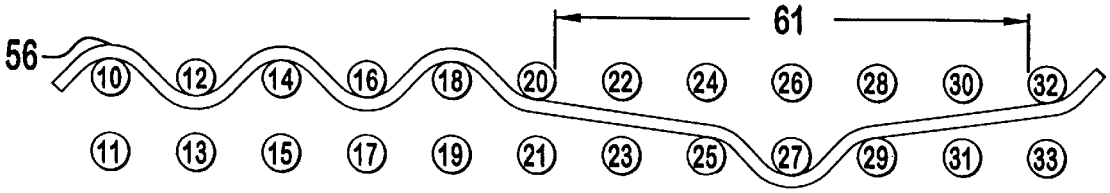
FIG. 8 illustrates the weave repeat for a second additional thread in accordance with the second embodiment.
Figure 9:
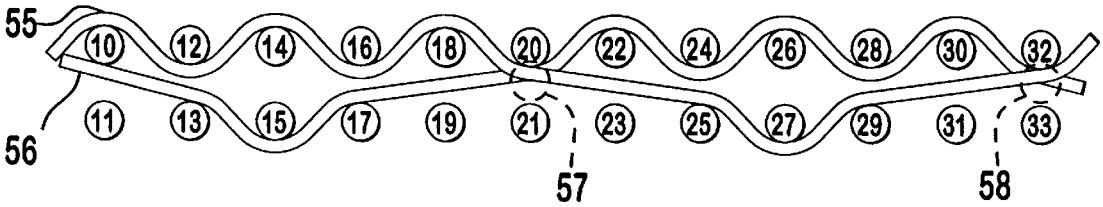
FIG. 9 shows the weave repeats of FIGS. 7 and 8 in combination.

With reference to FIGS. 7, 8 and 9, there is shown a second embodiment of the present invention. In this second embodiment, the first additional thread 55 weaves between MD thread pairs 10–11, 12–13, beneath MD threads 14–15, between MD thread pairs 16–17, 18–19, 20–21, and then in a plain weave repeat with the upper layer MD threads 24, 26, 28, 30,32.

The second additional thread 56 weaves in the mirror image of thread 55. As shown by FIG. 9, the threads 55 and 56 produce a plain weave pattern on the paper sheet side, relatively long transitions which combine to simulate a mid-plane float and cross over points 57, 58 which encourage migration of the threads relative to each other. As with the prior embodiment, this embodiment provides a continuous portion 61 of the weave repeat that extends over at least five adjacent paper side longitudinal threads between transitions from the machine or paper side longitudinal threads.

Figure 10:
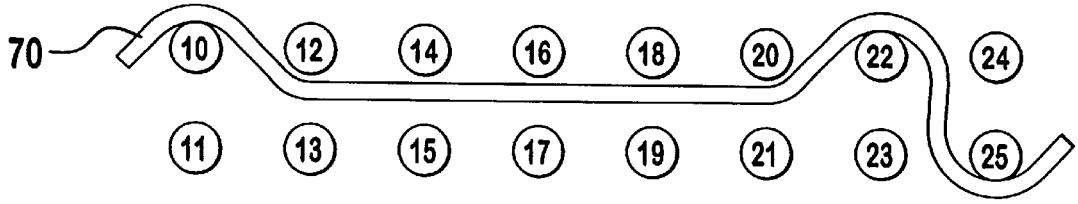
FIG. 10 illustrates the weave repeat for one additional thread in accordance with a third embodiment.
Figure 11:
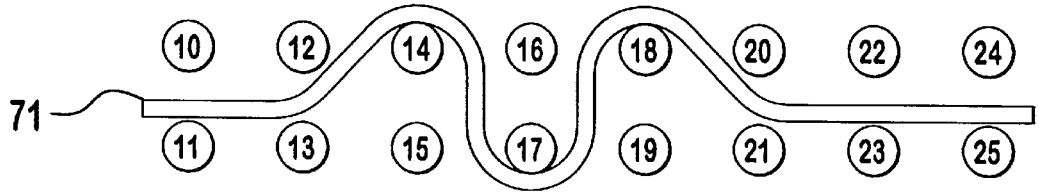
FIG. 11 illustrates the weave repeat for a second additional thread in accordance with the third embodiment.
Figure 12:
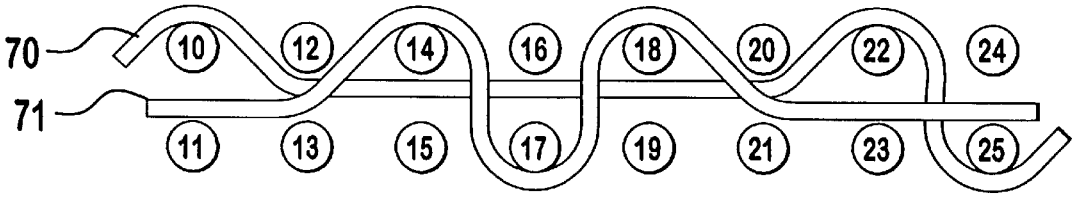
FIG. 12 shows the weave repeats of FIGS. 10 and 11 in combination.

Referring to FIGS. 10–12, a third embodiment is shown. The fabric repeats on sixteen MD threads 10–25. Each additional CMD thread 70 and 71 is interwoven in the seam zone 40 with both layers of MD threads 10 through 25. Additional CMD thread 70 preferably weaves in a repeat pattern that passes over MD threads 10–11, between MD thread pairs 12–13, 14–15, 16–17, 18–19, 20–21, over threads 22–23 and under MD threads 24–25. With reference to FIG. 11, the second additional thread 71 is woven in a complementary pattern to that of thread 70. Thus, CMD thread 71 weaves in a repeat that passes over threads 14–15, under threads 16–17, over threads 18–19 and between thread pairs 20–21,22–23,24–25 and 10–11, 12–14.

The complementary pattern of the repeats can be seen from FIG. 12. It will be noted from FIG. 12 that the weave repeats of threads 70 and 71 result in a transverse weave repeat that appears as a plain weave on the paper side surface of the fabric. Likewise, the mid-plane float repeat produces what is essentially a continuous float through the midplane of the fabric. This is particularly beneficial in two-layer fabric constructions. Finally, the weave repeats result in minimum interlacings on the machine side of the fabric.

Figure 13:
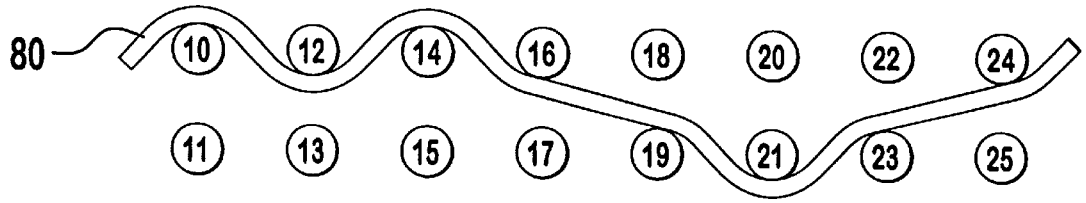
FIG. 13 illustrates the weave repeat for one additional thread in accordance with a fourth embodiment.
Figure 14:
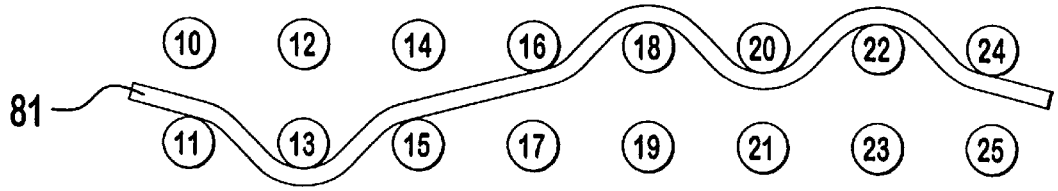
FIG. 14 illustrates the weave repeat for a second additional thread in accordance with the fourth embodiment.
Figure 15:
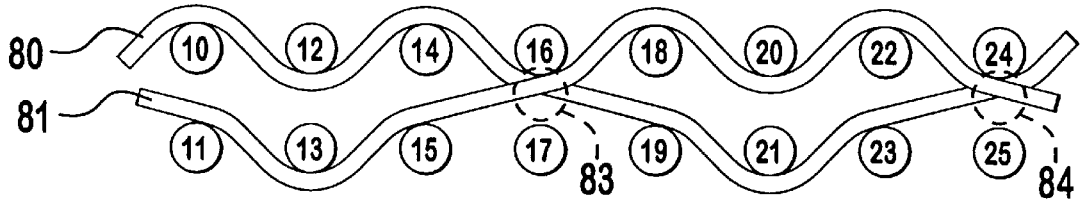
FIG. 15 shows the weave repeats of FIGS. 13 and 14 in combination.

Referring to FIGS. 13–15, a fourth embodiment of the present invention is shown. Each additional CMD thread 80 and 81 is interwoven in the seam zone 40 with both layers of MD threads 10 through 25. Additional CMD thread 80 preferably weaves in a repeat that passes over MD threads 10–11, between threads 12–13, over thread 14, between pairs of threads 16–17, 18–19, under threads 20–21 and between pairs of threads 22–23, 24–25.

With reference to FIG. 14, the second thread 81 is woven in a mirror image to the thread 80. Thus, CMD thread 81 weaves in a repeat that passes between the pair of threads 10–11, beneath the threads of pair 12–13, between the pairs 14–15 and 16–17, over the threads of pair 18–19, under thread 20, over the threads of pair 22–23, and between threads 24–25.

As can be seen from FIG. 15, two threads woven in accordance with FIGS. 13 and 14 produce a weave repeat structure having two crossover points 83 and 84 which are spaced apart by at least three MD threads. It will also be noted that MD thread 16 passes over both additional threads 80 and 81. Since the repeat pattern extends over eight pairs of MD threads with only a single interlacing in the machine side MD layer and the threads can shift beneath thread 16, threads 80 and 81 tend to act as one. As a result of the long transition and the interlacing patterns, the threads 80 and 81 can migrate relative to each other so that the resulting sheet side MD and CMD weave repeat appears to be a plain weave across the fabric.

In accordance with each of the embodiments of the invention described above, the additional threads 50, 51; 55, 56; 70,71 and 80,81 can be said to repeat on X paper side longitudinal threads 10, 12, 14, 16, 18, 20, 22, 24, 26, 28, 30 and 32. One of the additional threads weaves in a subrepeat pattern of over one, under one with Y of the paper side longitudinal threads 10, 12, 14, 16, 18, 20, 22, 24, 26, 28, 30 and 32 and the other additional thread weaves in a subrepeat pattern of over one, under one with X minus Y paper side longitudinal threads 10, 12, 14, 16, 18, 20, 22, 24, 26, 28, 30 and 32, where X is an integer and Y is an integer less than X. For example, in FIGS. 13–15, X is equal to eight and Y is equal to four, in FIGS. 2–5, X is equal to twelve and Y is equal to four, and in FIGS. 7–9, X is equal to twelve and Y is equal to six.

It will be appreciated that batt adhesion will be most improved on the sheet side surface but that some improvement in machine side surface adhesion will result from the presence of the interlacings and relatively long transitions.

The additional CMD threads 50, 51; 55, 56; 70, 71; and 80,81 can be multifilament, spun, braided, knitted, or bicomponent. If the thread is of a bicomponent nature, the bicomponent material may have a core material with a higher melting point surrounded by a covering of a lower melting point material. This allows the covering to melt and adhere to the batt material during finishing without affecting the core structure of the thread. Threads may be made from polymeric resins selected from a group consisting of polyamide, polyurethanes, polyesters, polyararnids, polyimides, polyolefins, polyetherketones, polypropylenes, PET, PBT, PTT, phenolics, and copolymers thereof.

What is claimed is:

1. An open ended papermaker's fabric of a type woven from a longitudinal thread system and a transverse thread system and having a paper side and a machine side, a plurality of seam loops at each end of the fabric formed by the threads of the longitudinal thread system whereby a seam zone is formed at each end of said fabric between the respective seam loops and a respective end thread of said transverse thread system, the fabric characterized by:

two additional transverse threads interwoven with the longitudinal thread system in at least one seam zone, the two additional threads woven in complementary weave repeat patterns that combine to provide a paper side repeated pattern of over one, under one across the repeat, and the longitudinal thread system being arranged in stacked longitudinal thread pairs, with one of the two additional transverse threads interwoven between each of the longitudinal thread pairs in the at least one seam zone.

2. The fabric of claim 1 wherein the additional threads migrate relative to one another such that a portion of one of the additional threads overlies a portion of the other additional thread.

3. The fabric of claim 1 wherein the additional threads repeat on X paper side longitudinal threads and one of the additional threads weaves in a subrepeat pattern of over one, under one with Y paper side longitudinal threads and the other additional thread weaves in a subrepeat pattern of over one, under one with X minus Y paper side longitudinal threads where X is an integer and Y is an integer less than X.

4. The fabric of claim 3 wherein X is equal to eight and Y is equal to four.

5. The fabric of claim 3 wherein X is equal to twelve and Y is equal to four.

6. The fabric of claim 3 wherein X is equal to twelve and Y is equal to six.

7. The fabric of claim 1 wherein each of the additional threads weaves in a repeated pattern which is free of any over one, under one subrepeats with respect to the paper side longitudinal threads.

8. A method of producing a papermaker's fabric comprising the steps of:

interweaving a longitudinal thread system with a transverse thread system to define a base fabric having first and second ends and a paper side and a machine side;

forming a plurality of seam loops at each end of the fabric from the threads of the longitudinal thread system and defining a seam zone at each end of said fabric between the respective seam loops and a respective end thread of said transverse thread system; and interweaving two additional transverse threads in at least one seam zone with the longitudinal thread system with the two additional threads woven in complementary weave repeat patterns that combine a paper side repeated pattern of over one, under one across the repeat, the longitudinal thread system being arranged in stacked longitudinal thread pairs, with one of the two additional transverse threads interweaving between each of the longitudinal thread pairs in the at least one seam zone.

* * * * *